United States Patent [19]

Bohm et al.

[11] 4,341,556

[45] Jul. 27, 1982

[54] MATERIAL FOR ELECTRICAL CONTACTS

[75] Inventors: Wolfgang Bohm, Alzenau; Roger Wolmer, Frankfurt; Andreas Szulczyk, Linsengericht; Willi Malikowski, Aschaffenburg, all of Fed. Rep. of Germany

[73] Assignee: Degussa - Aktiengesellschaft, Frankfurt, Fed. Rep. of Germany

[21] Appl. No.: 259,197

[22] Filed: Apr. 30, 1981

[30] Foreign Application Priority Data

May 7, 1980 [DE] Fed. Rep. of Germany ..... 3017424

[51] Int. Cl.[3] ..... C22C 5/06; H01B 1/02

[52] U.S. Cl. ..... 75/173 A; 75/232; 75/234; 252/514; 200/266

[58] Field of Search ..... 75/232, 234, 206, 134 D, 75/173 A, 175 A, 951; 252/514; 200/265, 266; 428/929

[56] References Cited

U.S. PATENT DOCUMENTS

| | | | |
|---|---|---|---|
| 3,755,723 | 8/1973 | Short | 252/514 |
| 3,798,516 | 3/1974 | Short | 252/514 |
| 3,933,485 | 1/1976 | Shibata | 75/173 A |
| 3,933,486 | 1/1976 | Shibata | 75/173 A |
| 4,141,727 | 2/1979 | Shida | 252/514 |
| 4,204,863 | 5/1980 | Schreiner | 75/234 |
| 4,242,135 | 12/1980 | Shibata | 75/173 A |
| 4,243,413 | 1/1981 | Shibata | 75/206 |

FOREIGN PATENT DOCUMENTS

| | | | |
|---|---|---|---|
| 2428147 | 2/1975 | Fed. Rep. of Germany | 200/266 |
| 2428146 | 8/1975 | Fed. Rep. of Germany | 200/266 |
| 2824117 | 12/1979 | Fed. Rep. of Germany | 75/206 |
| 52-33067 | 3/1977 | Japan | 75/173 A |
| 54-128427 | 10/1979 | Japan | 75/173 A |
| 54-147479 | 11/1979 | Japan | 75/173 A |
| 55-43775 | 3/1980 | Japan | 75/206 |
| 55-134144 | 10/1980 | Japan | 75/173 A |

OTHER PUBLICATIONS

*Chemical Abstracts*, vol. 90, 1979, Abstract No. 90:146524z, Ezawa, Nobuyasu, "Silver–Tin Oxide Type Contact Material".

*Chemical Abstracts*, vol. 94, 1981, Abstract No. 94:196245s, Boehm, Wolfgang, German Offen. 2933338, 2–1981, "Silver Alloy for Electrical Contacts".

*Primary Examiner*—L. Dewayne Rutledge
*Assistant Examiner*—J. J. Zimmerman
*Attorney, Agent, or Firm*—Cushman, Darby & Cushman

[57] ABSTRACT

There is described a material for electrical contacts based on silver having 5 to 20 weight % tin oxide and 0.5 to 5 weight % tungsten oxide which has the welding strength reduced further without producing an increased switching temperature. The material contains additionally 0.1 to 5 weight % of bismuth oxide.

4 Claims, No Drawings

MATERIAL FOR ELECTRICAL CONTACTS

BACKGROUND OF THE INVENTION

The invention is directed to a material for electrical contacts made of silver containing 5 to 20 weight % tin oxide and 0.05 to 5% tungsten oxide.

Until now for numerous uses Ag/CdO has proven best for the production of electrical contact pieces. However, because of the load on the environment caused by CdO there have been increased efforts to replace CdO by another metal oxide. In these investigations it has been shown that $SnO_2$ is a suitable replacement for CdO. Besides because of the higher thermal stability of $SnO_2$ compared to CdO there is obtained a clearly reduced burn-up rate which leads to longer life in the switching apparatus. However, one very substantial disadvantage of Ag/$SnO_2$ is that the transfer resistance at the contact after several thousands of switchings becomes too high through formation of a covering layer. Then as a rule this leads to increased temperatures in the switching apparatus which can lead to the destruction of the apparatus and consequently is inadmissible.

A further disadvantage of this Ag/$SnO_2$ work material compared to Ag/CdO is in the lower safety against welding. The forces which are required to destroy the bridge weld are partially double as high as with Ag/-CdO contacts. Therewith there is the danger of switching disturbances in employing Ag/$SnO_2$. Therefore there have been attempts to increase the welding safety by the addition of additional metal oxide to Ag/$SnO_2$, in which case for example bismuth oxide ($Bi_2O_3$) (German OS 2754335) or indium oxide (German OS 2478147) have been used. Indeed these additives improve the welding safety but cause an increased temperature at the contact and at the switching apparatus which is detrimental to the life of the apparatus.

There is known from German OS 2933338 an electrical contact material of silver having 8 to 20 weight % of tin oxide and 0.05 to 5 weight % of tungsten oxide. With this material the transfer resistances of silver-tin oxide materials in the switching condition after several thousand switchings up to the end of the life are lowered to the value of Ag/CdO. Therethrough this new silver-tin oxide material is usable as direct replacement for silver-cadmium oxide in a number of uses in the electrical energy art.

Furthermore the safety against welding of switching on contacts compared to pure silver-tin oxide is increased through the tungsten oxide. The forces required to separate the contacts, however, on the average exceed the values of special silver-cadmium oxide materials.

Therefore it was the problem of the present invention to develop a material for electrical contacts based on silver having 5 to 20 weight % tin oxide and 0.05 to 5 weight % tungsten oxide which further reduces the welding force without at the same time producing an increased temperature at the contact and therewith to reduce the life of the switching apparatus.

SUMMARY OF THE INVENTION

This problem was solved by additionally including in the silver based material containing 5 to 20 weight % tin oxide and 0.05 to 5 weight % tungsten oxide also 0.1 to 5 weight % bismuth oxide ($Bi_2O_3$).

Unless otherwise indicated all parts and percentages are by weight.

The composition can comprise, consist essentially of or consist of the stated materials and preferably consists essentially of or consists of such materials.

Surprisingly it has been shown that an addition of 0.1 to 5% of bismuth oxide to silver-tin-oxide-tungsten oxide is suitable to further reduce the welding force to values which also are equal to optimal silver-cadmium oxide. A further substantial advantage of the addition of bismuth oxide is that contact resistances which are reduced by the addition of tungsten oxide, are not increased again as was found with the other metal oxides and was expected.

The material of silver having 5 to 20 weight % tin oxide, 0.05 to 5 weight % tungsten oxide and 0.1 to 5 weight % bismuth oxide represents consequently a particularly burn-up resistant and welding safe material with lower transfer resistance.

DETAILED DESCRIPTION

The following table shows the properties of the material of the invention in comparison to known materials.

The entire disclosure of German priority application P 3017424.4 is hereby incorporated by reference.

TABLE

| Material | Life (Number of Switchings) | Welding Force N 99.5% of all values are below | Temperature after over 30 000 Switchings °C. |
|---|---|---|---|
| Ag/CdO 88/12 powder metallurgically | about 50 000 | 120–200 | 70–80 |
| Ag/CdO 90/10 internally oxidized | about 50 000 | 180–250 | 70–80 |
| Ag/$SnO_2$ 88/12 powder metallurgically | about 140 000 | 250–350 | 110–140 |
| Ag/$SnO_2$/$WO_3$ 88/11.5/05 | about 140 000 | 150–220 | 70–80 |
| Ag/$SnO_2$/$WO_3$/$Bi_2O_3$ 88/10.5/0.5/1 | about 140 000 | 110–160 | 70–80 |

What is claimed is:

1. A material suitable for electrical contacts consisting essentially of silver containing 5 to 20 weight % tin oxide, 0.05 to 5 weight % tungsten oxide and 0.1 to 5 weight % bismuth oxide.

2. A material according to claim 1 wherein the bismuth oxide is 0.5 weight %.

3. A material according to claim 2 containing 88 weight % Ag, 10.5 weight % $SnO_2$, 0.5 weight % $WO_3$ and 1 weight % $Bi_2O_3$.

4. An electrical contact made of the material of claim 1.

* * * * *